US006234820B1

(12) United States Patent
Perino et al.

(10) Patent No.: US 6,234,820 B1
(45) **Date of Patent: *May 22, 2001**

(54) METHOD AND APPARATUS FOR JOINING PRINTED CIRCUIT BOARDS

(75) Inventors: Donald V. Perino, Los Altos; John B. Dillon, *deceased*, late of Palo Alto, both of CA (US), by Nancy David Dillon, executrix

(73) Assignee: Rambus Inc., Los Altos, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/898,141

(22) Filed: Jul. 21, 1997

(51) Int. Cl.[7] ..... H01R 13/00
(52) U.S. Cl. ..... 439/326; 439/496
(58) Field of Search ..... 439/67, 73, 326–329, 439/492, 493, 499, 496

(56) References Cited

U.S. PATENT DOCUMENTS

| | | | | |
|---|---|---|---|---|
| 3,082,398 | * | 3/1963 | Valach | 439/936 |
| 3,114,587 | * | 12/1963 | Herrmann | 439/329 |
| 3,701,071 | * | 10/1972 | Landman | 439/326 |
| 3,874,768 | | 4/1975 | Cutchaw . | |
| 4,426,689 | | 1/1984 | Henle et al. . | |
| 4,586,764 | | 5/1986 | Mullen, III et al. . | |
| 4,598,962 | | 7/1986 | Reitz et al. . | |
| 4,636,022 | | 1/1987 | Sonobe . | |
| 4,678,252 | * | 7/1987 | Moore | 439/326 |
| 4,714,435 | * | 12/1987 | Stipanuk et al. | 439/326 |
| 4,795,079 | | 1/1989 | Yamada . | |
| 4,798,541 | | 1/1989 | Porter . | |
| 4,850,892 | | 7/1989 | Clayton et al. . | |
| 4,885,126 | | 12/1989 | Polonio . | |

(List continued on next page.)

FOREIGN PATENT DOCUMENTS

| | | |
|---|---|---|
| 3-611346 | 10/1987 | (DE) . |
| 0 226 276 | 6/1987 | (EP) . |
| 0 472 203 | 2/1992 | (EP) . |
| 0 542 433 | 5/1993 | (EP) . |
| 2 109 444 | 5/1972 | (FR) . |
| 55-138264 | 10/1980 | (JP) . |
| 59-130453 | 7/1984 | (JP) . |
| 59-312217 | 7/1984 | (JP) . |
| 1-166545 | 6/1989 | (JP) . |
| 10-150065 | 2/1998 | (JP) . |
| 9318559 | 9/1993 | (WO) . |

OTHER PUBLICATIONS

European Search Report, 1 page.

"Chip to Package Interconnections", chapter form book: Optoelectric Interconnections, pp. 436, 437 & 463.

Terry Cosslouc, Connector Combines Metal With Elastomers, 1 page.

R. Cook, "More Memory In Less Space", Byte Magazine, pp. 197, 198, 200 (Jun. 1995).

D, Brearkey, Jr., "Assuming Reliability Of Surface Mounted Connectors", National Electronic Packaging and Production Conference, pp. 606–614 (Feb. 25–27, 1986).

(List continued on next page.)

*Primary Examiner*—Hien Vu
(74) *Attorney, Agent, or Firm*—Blakely, Sokoloff, Taylor & Zafman LLP

(57) ABSTRACT

A method and apparatus for joining printed circuit boards is provided. A socket is attached to a mother board. A connector is attached to a daughter board. The traces on the daughter board are connected to signal leads, which are wrapped around an elastomer. The socket and the connector are engaged, such that the mother board is coupled to a daughter board, and the traces on the mother board are coupled to the signal leads of the daughter board.

16 Claims, 9 Drawing Sheets

U.S. PATENT DOCUMENTS

| | | | | |
|---|---|---|---|---|
| 4,891,023 | | 1/1990 | Lopata . | |
| 4,939,570 | | 7/1990 | Bickford et al. . | |
| 4,967,262 | | 10/1990 | Farnsworth . | |
| 4,975,763 | | 12/1990 | Baudouin et al. . | |
| 5,002,494 | | 3/1991 | Olsson . | |
| 5,026,297 | * | 6/1991 | Krehbiel | 439/326 |
| 5,051,366 | * | 9/1991 | Anderson et al. | 439/326 |
| 5,104,324 | | 4/1992 | Grabbe et al. . | |
| 5,229,916 | | 7/1993 | Frankeny et al. . | |
| 5,260,601 | | 11/1993 | Baudouin et al. . | |
| 5,278,724 | | 1/1994 | Angulas et al. . | |
| 5,337,220 | * | 8/1994 | Granitz | 439/326 |
| 5,432,678 | | 7/1995 | Russell et al. . | |
| 5,482,474 | | 1/1996 | Yohn et al. . | |
| 5,568,363 | | 10/1996 | Kitahara . | |
| 5,569,045 | | 10/1996 | Hsu . | |
| 5,610,642 | | 3/1997 | Nobel . | |
| 5,633,533 | | 5/1997 | Andros et al. . | |
| 5,673,479 | | 10/1997 | Hawthorne et al. . | |
| 5,748,209 | | 5/1998 | Chapman . | |
| 5,790,380 | | 8/1998 | Frankeny . | |
| 5,903,292 | | 5/1999 | Scheffelin et al. . | |

OTHER PUBLICATIONS

D, Brearky, Jr., "The Connector/PCB Interface Key to Success In Surface Mounting Of Connectors", N.E.P. and Production Conference, pp. 427–434 (Feb. 25–27, 1986).

M.A. Choudhury, "Fasteners Take On New Shapes", Electronic Packaging & Production, pp. 58–59, (May 1986).

R. P. Goel, "Greater Packaging Density Through Direct Surface Mounting Of Components", pp. 17–20 (Dec. 1986).

N. Janota, et al,, "The Connectorization Of Surface–Mount PC Boards", Design News, pp. 88–90 (Jun. 16, 1986).

D. L. Timmins, "An Elastomeric Interconnect System For Fine Pitch Leadless Chip Carriers, " IEEE 34th Electronic Components Conference, pp. 138–143 (May 14–16, 1984).

M. Gates, "Supporting The Surface Mounting Switchover", New Electronics, pp. 63, 65, 67 (Jun. 26, 1984).

PCT International Search Report, International Application No. PCT/US98/15056, filed Jul. 21, 1998, mailed Jan. 25, 1999, 5 pages.

IBM Technical Disclosure Bulletin "Inexpensive Chip Package", vol. 33, No. 1A, pp. 272 & 273.

Written Opinion PCT/US98/15056, 5 pages.

* cited by examiner

METHOD AND APPARATUS FOR JOINING PRINTED CIRCUIT BOARDS

FIELD OF THE INVENTION

The present invention relates to printed circuit boards, and more specifically, to joining printed circuit boards.

BACKGROUND OF THE INVENTION

Printed circuit boards are joined together in order to form a larger board. Joining printed circuit boards may be advantageous, for example, to join because different printed circuit boards, manufactured by different manufacturers and serving different functions. Additionally, printed circuit board size is limited, and by joining together printed circuit boards, larger boards may be formed.

One prior art method of joining printed circuit boards is using stamped metal leads. Stamped metal leads are soldered to traces on one of the printed circuit boards to be joined together. These stamped metal leads provide the spring force needed to establish electrical contact. A standard connection may require up to 50 grams (g) of force on each metal lead. For a 64 metal lead printed circuit board, this would be 50 g * 64=3200 g=3.2 kg=7.04 pounds. Therefore, the stamped metal leads have to provide sufficient spring force to provide such pressure. Typically, stamped metal contacts increase metal lead length in order to provide the required spring force. When the daughter board is coupled to the mother board, the metal contacts are first wiped, and then coupled together. Generally the stamped metal contacts are soldered. In this way a secure connection is established.

This method has numerous disadvantages. Usually the boards can only be attached end to end. The connection is not easily disconnected. The initial wiping required makes these boards not field replaceable. Gold leads are expensive, but are used because other metals do not provide sufficient spring force. The length of the stamped metal contacts is determined by the spring force needed. Since the metal contacts provide the spring force, the impedance and inductance of the spring metal contacts is not controlled.

SUMMARY AND OBJECTS OF THE INVENTION

It is an object of this invention to provide for a low cost separable interconnect between printed circuit boards.

It is a further object of this invention to provide a controlled impedance connection between printed circuit boards.

It is a further object of this invention to provide a low inductance connection between printed circuit boards.

It is an object of this invention to provide for a method of joining printed circuit boards which provides a wipe.

The present invention includes a mother board which has a socket. The present invention further includes a daughter board which has a connector. The traces on the daughter board are connected to signal leads, which are wrapped around an elastomer. The mother board is coupled to a daughter board when the connector is engaged with the socket, and the traces on the mother board are coupled to the signal leads of the daughter board.

Other objects, features, and advantages of the present invention will be apparent from the accompanying drawings and from the detailed description that follows below.

DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A method and apparatus for joining printed circuit boards is described. A socket is attached to one board, the mother board. A connector, which is designed to fit into the socket, is attached to the second board, the daughter board. Leads are coupled to the traces on the printed circuit boards. The leads of the daughter board are wrapped around an elastomer, which provides flexibility. This permits the use of leads made of copper, brass, stamped metal, or other materials. Because the flexibility and conductivity functions are separated, the leads can be tailored to provide the right about of impedance. The connector is inserted into the socket, using a rotational movement, which provides a wipe to the leads, thus cleaning the leads. When the mother board and daughter board are joined, the elastomer is underneath the contact portion of the leads.

Figure 1:
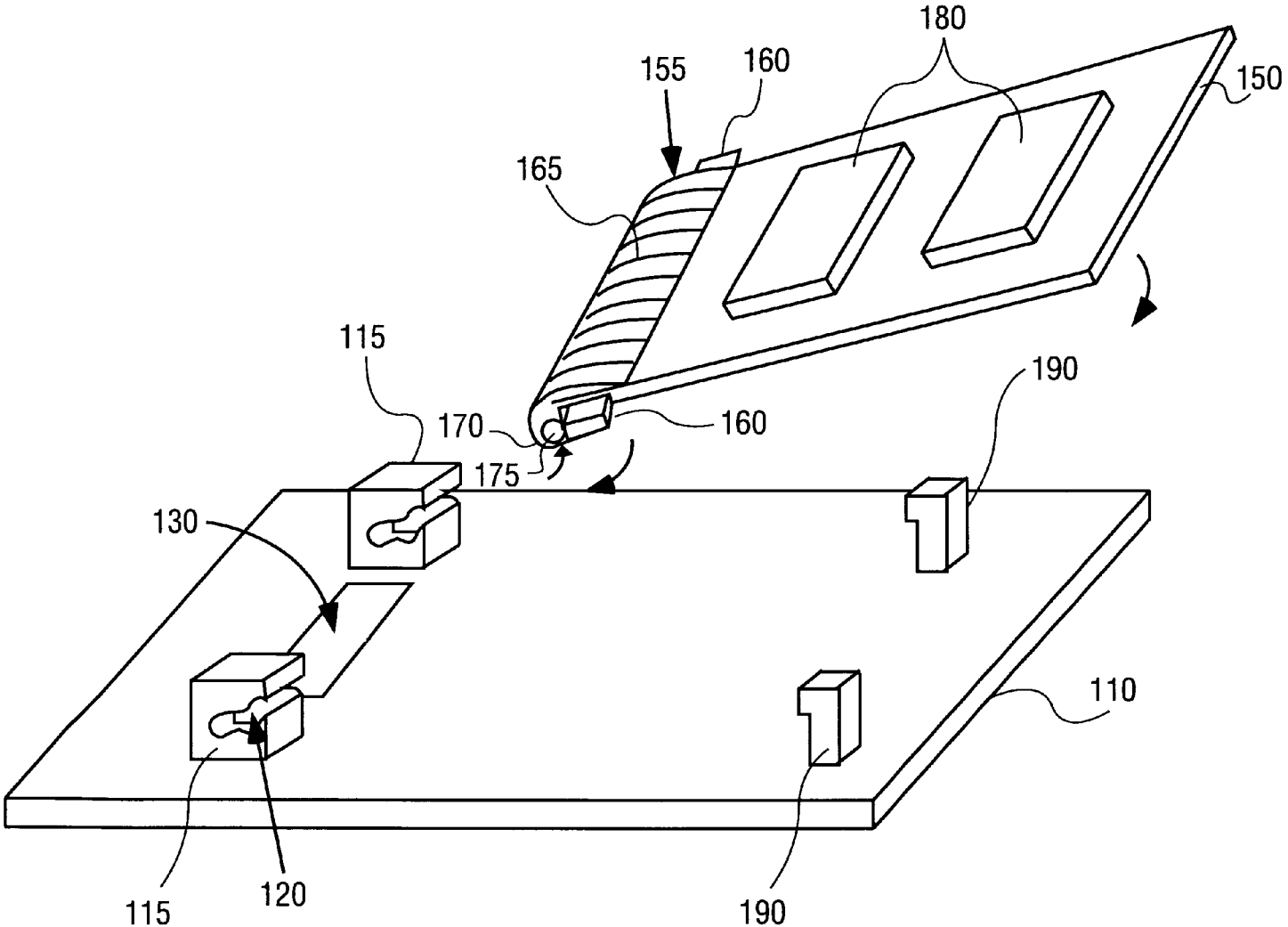
FIG. 1 is a perspective illustration of one embodiment of the connectors of the present invention.

FIG. 1 is a perspective view of one embodiment of the present invention. The mother board 110 and daughter board 150 may be printed circuit boards having any type of functionality. For one embodiment, the mother board 110 includes dynamic random access memory (DRAM) and a DRAM controller, and the daughter board 150 includes additional DRAM modules.

Sockets 115 are coupled to the motherboard 110. The sockets 115 may be part of two substantially parallel rails coupled to the motherboard 110. Thus, a first rail may include the right socket 115, while the second rail includes the left socket 115. This allows a plurality of daughter boards to be attached to the mother board. For one embodiment, the sockets 115 are made of metal or similar rigid material. The sockets have to withstand substantial pressure when the daughter board is inserted into the socket 115, and therefore the sockets 115 have to be made of a rigid material. For one embodiment, the sockets 115 are fastened to the mother board using screws, bolts or similar materials. Alternatively, the sockets 115 may be glued or epoxied to the mother board 110.

Two latches 190 are also coupled to the motherboard 110. The latches 190 are to keep the daughter board 150 in place. For one embodiment, the latches 190 are also part of the rails connecting the sockets. For one embodiment, the latches 190 are plastic such that they flex in order to allow the daughter board 150 to be inserted.

The motherboard 110 further includes a plurality of traces (not shown) and a contact area 130. The contact area is the area to which the daughter board is electrically coupled. For one embodiment, the contact area is a portion of the traces to which the daughter board is coupled. The contact area is described in more detail with respect to FIG. 2.

A daughter board 150 is positioned to be coupled to the mother board 110. The daughter board 150 may include a plurality of integrated circuits 180. The daughter board includes a connector 155. The connector 155 couples the daughter board 150 to the motherboard. The connector 155 includes two cam followers 160 on either side of the daughter board 150. The cam followers 160 fit into the opening 120 of the sockets 115 on the motherboard 110, to fix the daughter board 150 to the motherboard 110. The connector 155 further includes signal leads 165. The signal leads 165 are coupled to traces on the daughter board 150 (not shown). The signal leads 165 are wrapped around the edge of the daughter board 150, and make contact with the contact area 130 of the motherboard 110 when the two boards are coupled. The signal leads 165 have a contact portion 175, which touches the contact area 130 of the mother board 110 when the daughter board 150 and mother board 110 are coupled together. An elastomer 170 is positioned underneath the contact portion 175 of the signal leads 165. The elastomer 170 provides flexibility. Therefore, the signal leads 165 do not need to provide the spring force necessary to couple the boards together. This permits tailoring of the signal leads 165 for electrical characteristics only, while the elastomer 170 provides the spring force needed. The end of the daughter board 150 is latched by the latches 190 to the mother board 110, thereby fixing the daughter board 150 to the motherboard 110. The elastomer 170 is positioned between the edge of the daughter board 150 and the signal leads 165 on the daughter board 150.

When the daughter board 150 is coupled to the mother board 110, the cam followers 160 are positioned within the openings 120 of the sockets 115. The daughter board 150 is inserted at an angle, and then moved to the horizontal position. This movement rubs the contact portion 175 of the signal leads 165 against the contact area 130 of the motherboard 110, thereby providing a wipe of both the signal leads 165 and the contact area 130. The wipe provided by the motion cleans of dirt and breaks the surface oxide on the contacts. This improves the electrical characteristics of the connection. The rotational motion also provides leverage for sufficient compression. The connection should have a constant pressure of approximately 50–100 grams (g) per contact. The pressure should be greater than the force required to break the oxide, in order to prevent the contact from oxidizing. For example, if there are 60 signal leads, the force required is 50 g/lead * 60 leads=3000 g=3 kg. However, the elastomer has a compression set. Thus, an initial compression of greater than 3 kg is used in order to have a final compression of 3 kg. For one embodiment, the initial force is sufficiently large such that even with maximum compression set of the elastomer, the final force is in the region of stable contact resistance. The rotational movement during insertion is advantageous because it provides leverage for the required compression.

Figure 2:
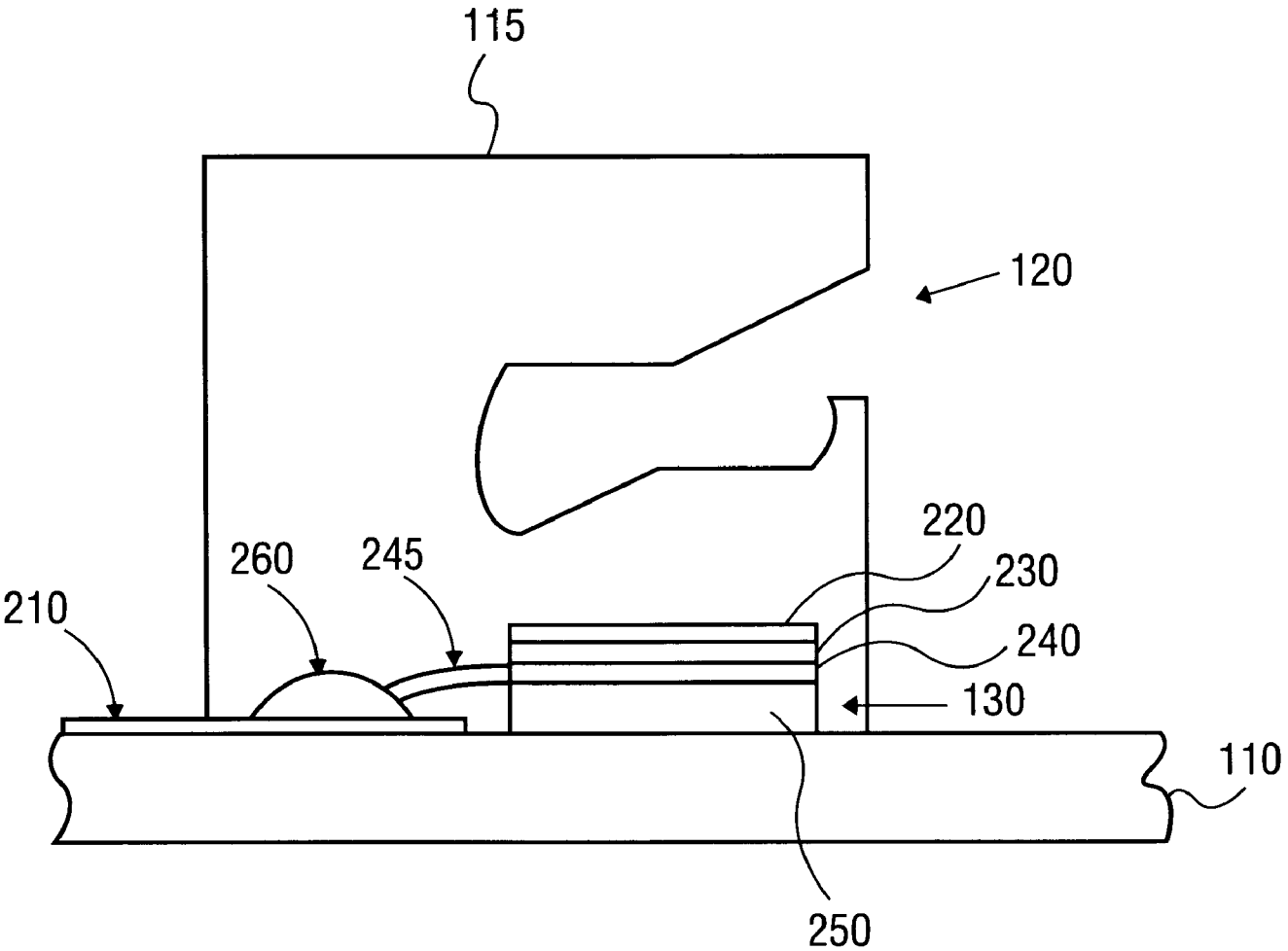
FIG. 2 is a close-up of one embodiment of a cross-section of the motherboard.

FIG. 2 is an illustration of one embodiment of the cross-section of the motherboard, including the socket and a portion of the contact area. One socket 115 is shown. In front of the socket, a portion of the contact area 130 is shown. The mother board 110 includes traces 210. For one embodiment, the traces 210 are copper.

The socket 115, or housing, is coupled to the mother board 110. For one embodiment, a screw is used to couple the socket 115 to the motherboard 110. Alternatively, epoxy, solder, or any other technique may be used. For one embodiment, the socket 115 is made of metal. The socket has an opening 120, shaped to accept a cam follower 160 of the daughter board 150. The opening 120 is shaped with an angular entry, and provides a substantially horizontal resting place for the daughter board 150.

The contact area 130 is for contacting the signal leads 165 of the daughter board. For one embodiment, the contact area 130 is a flex circuit. The flex circuit 130 consists of a first polyimide layer 250, a copper lead layer 240, a nickel flash layer 230, and a gold flash layer 220. The nickel and gold layers 230, 220 are to improve the contact between the mother board 110 and daughter board 150. The copper lead layer 240 is coupled to the traces 210 on the mother board 110, using solder 260 or a similar conductive adhesive. Alternately, the contact area 130 may have different layers. The contact area 130 has at least one top layer which is in electrical contact with the signal leads 165 of the daughter board when the daughter board 150 and mother board 110 are joined.

Figure 3:
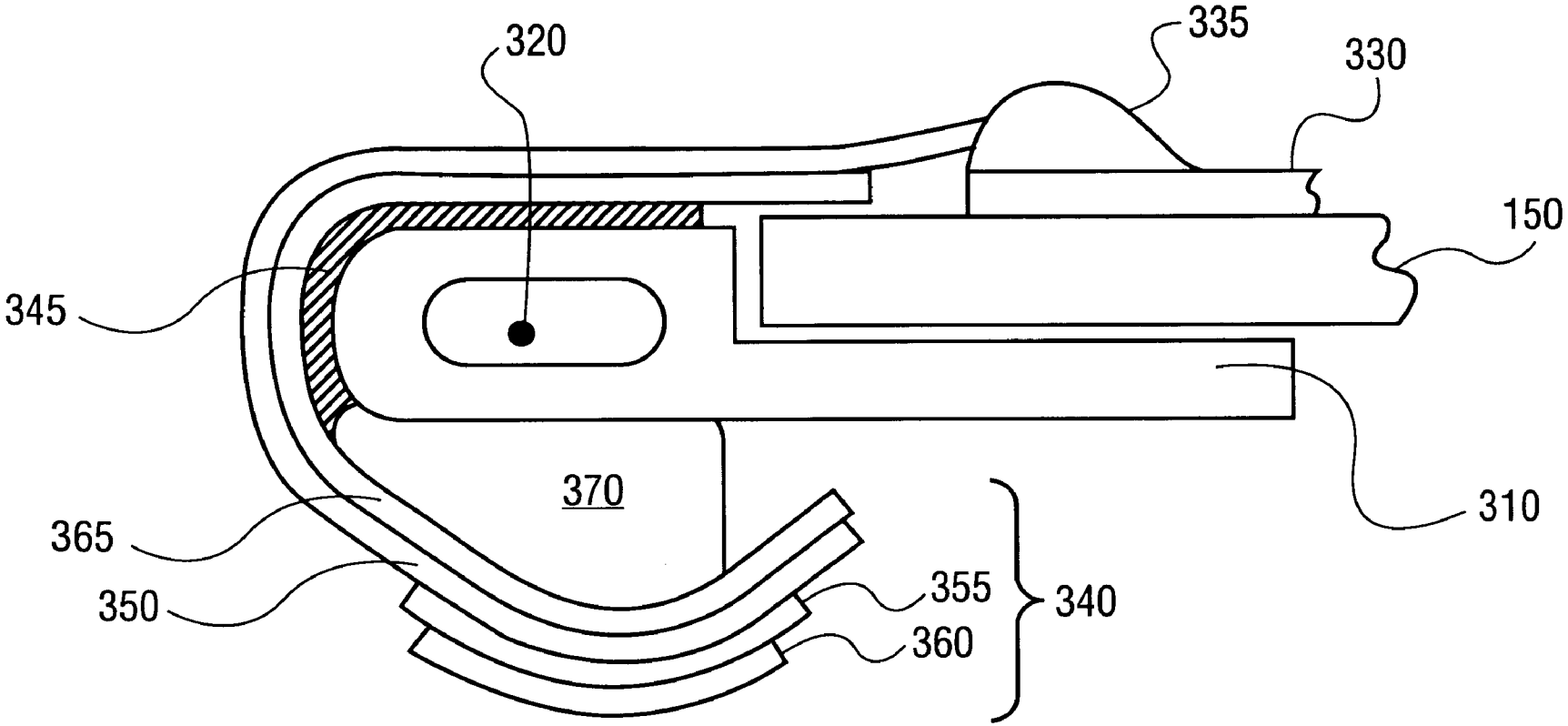
FIG. 3 is a close-up of one embodiment of the daughter board of the present invention.

FIG. 3 is an illustration of one embodiment of the portion of the daughter board which makes contact with the motherboard 110. A portion of the daughter board 150 is illustrated. The daughter board 150 has a number of traces 330. For one embodiment, the traces 330 are copper.

A rigid substrate 310 is attached to the end of the daughter board 150 which is in contact with the motherboard 110. For one embodiment, the rigid substrate 310 is bolted to the daughter board 150. The rigid substrate 310 may be metal, or any other material which can support the pressure required to establish contact. The rigid substrate 310 has a flat base area which is coupled to the daughter board 150. The rigid substrate 310 has a head, which extends beyond the end of the daughter board 150. For one embodiment, the end of the rigid substrate 310 is rounded. The rigid substrate 310 includes cam followers 320. The cam followers 320 are for engaging the socket 115 on the motherboard 110. For one embodiment, the rigid substrate 310 is a stamped metal including the cam followers 320 in a single element.

Signal traces 350 are coupled to the rigid substrate 310. The signal traces 350 are for coupling the traces 330 of the daughter board 150 to the mother board. For one embodiment, the signal traces 350 are included in a flex circuit 340. For one embodiment, the flex circuit includes a first flexible layer 365, a conductive layer 350, and a first and second contact layers 355, 360. For one embodiment, the flexible layer 365 is polyimide, the conductive layer 350 is copper, the first contact layer 355 is nickel, while the second contact layer 360 is gold. Note that the conductive layer 350 contains a plurality of signal traces which correspond to the traces 330 on the daughter board 150. The signal traces of conductive layer 350 of the flex circuit 340 are coupled to traces 330 on the daughter board, using solder 335 or a similar adhesive. The flex circuit 340 may be attached to the rigid substrate 310 using an adhesive 345 such as epoxy. For one embodiment, the flex circuit 340 is Kapton by Du Pont de Nemurs, or copper on polyimide.

An elastomer 370 is underneath the portion of the flex circuit 340 which is in contact with the mother board 110 when the daughter board 150 and mother board 110 are joined. For one embodiment, the elastomer 370 is fluorosilicone, silicone rubber, fluoroelastomer, or similar material. For one embodiment, the shape of the elastomer 370 is rounded toward the bottom, such that the contact area of the signal traces is limited. For one embodiment, the elastomer is selected such that it has a low compression set of 5% or less, that is, the elastomer under long term compression loses less than 5% of its force.

Figure 4:
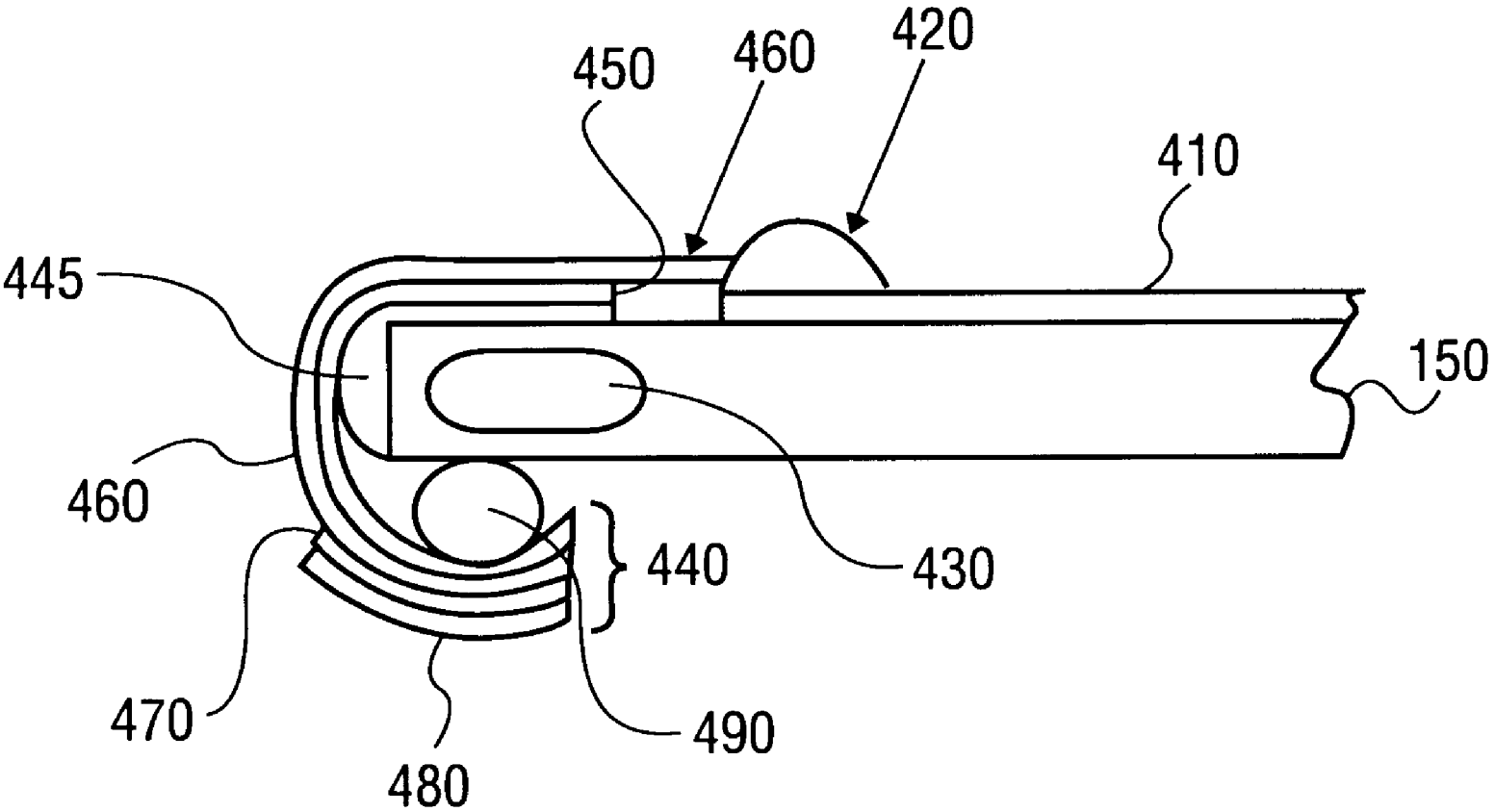
FIG. 4 is a close-up of another embodiment of the daughter board of the present invention.

FIG. 4 is an illustration of an alternative embodiment of the portion of the daughter board which makes contact with the motherboard. The daughter board 150 includes traces 410. A cam follower 430 is attached on the side of the daughter board 150. The cam follower 430 is to engage the socket of the mother board in order to secure the daughter board 150 to the mother board 110.

A flex circuit 440 is attached to the daughter board 150 using an adhesive 445, such as epoxy. The flex circuit 440 is for leading the traces 410 of the daughter board 150 to area of contact with the mother board 110. Underneath the contact area of the flex circuit 440 an elastomer 490. The elastomer is for providing flexibility to the signal traces of the flex circuit 440. For one embodiment the elastomer is substantially cylindrical in shape. The portion of the flex circuit 440 over elastomer 490 oncludes layers 450,460,470 and 480.

Figure 5:
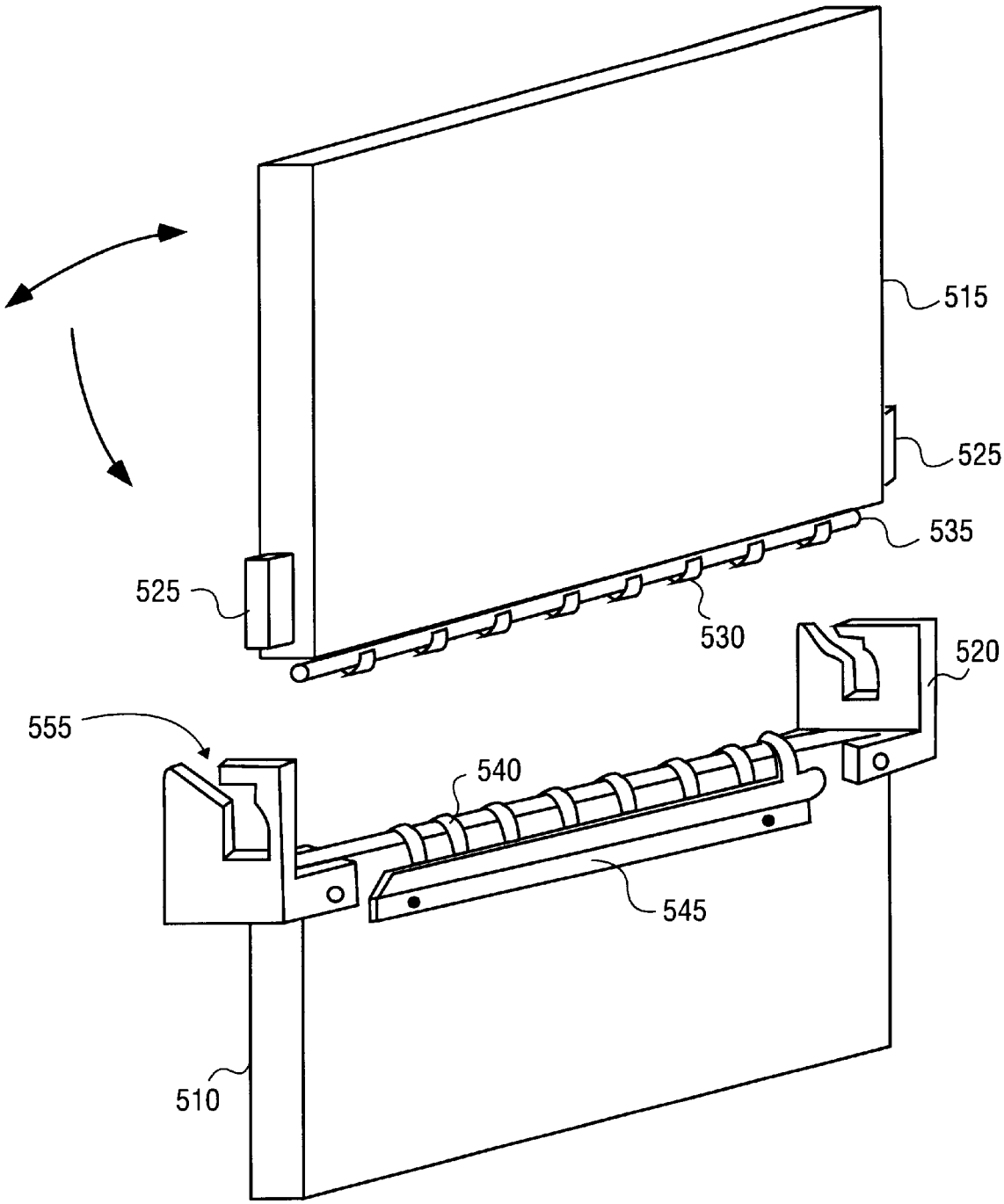
FIG. 5 is an illustration of another embodiment of the connectors of the present invention.

FIG. 5 is an illustration of one embodiment of the printed circuit boards to be joined in the present invention. A daughter board 515 is to be joined to a mother board 510.

There are traces on the mother board 510 and daughter board 515 (not shown). The traces connect devices on the board (not shown). The one end of traces on the mother board 510 are coupled to leads 540. For one embodiment, one end of the leads 540 are soldered to the traces on the mother board 510. The leads are wrapped around the edge of the mother board 510. The other end of the leads 540 are fastened down with a clamping piece 545. The clamping piece 545 fastens the loose ends of the leads 540 to the other side of the mother board 510. Similarly, for the daughter board 515, signal leads 530 are coupled to the traces on the daughter board 515. However, the signal leads 530 on the daughter board are wrapped around an elastomer 535. The elastomer 535 is a flexible piece of material which provides resilience and flexibility to the leads 530 and removes pressure from the leads 530. For one embodiment, the elastomer 535 is made of flourosilicone, fluoroelastomer, silicone rubber, or a similar material.

The mother board 510 includes a socket 520. The socket 520 is designed to receive a connector 525 which is attached to the daughter board. The socket 520 has a socket opening 555, into which the connector 525 is inserted. When the socket 520 and connector 525 are engaged, the mother board 510 and daughter board 515 are joined. For one embodiment, the socket 520 and connector 525 are molded plastic. Alternatively, the socket and connector may be made of other materials, such as metal. The socket 520 is fastened to the mother board 510 with a fastener 550. For one embodiment, the fastener 550 is a screw. Alternatively, the fastener 550 may be a bolt, glue, solder, rivet, or other fastening means.

Figure 6:
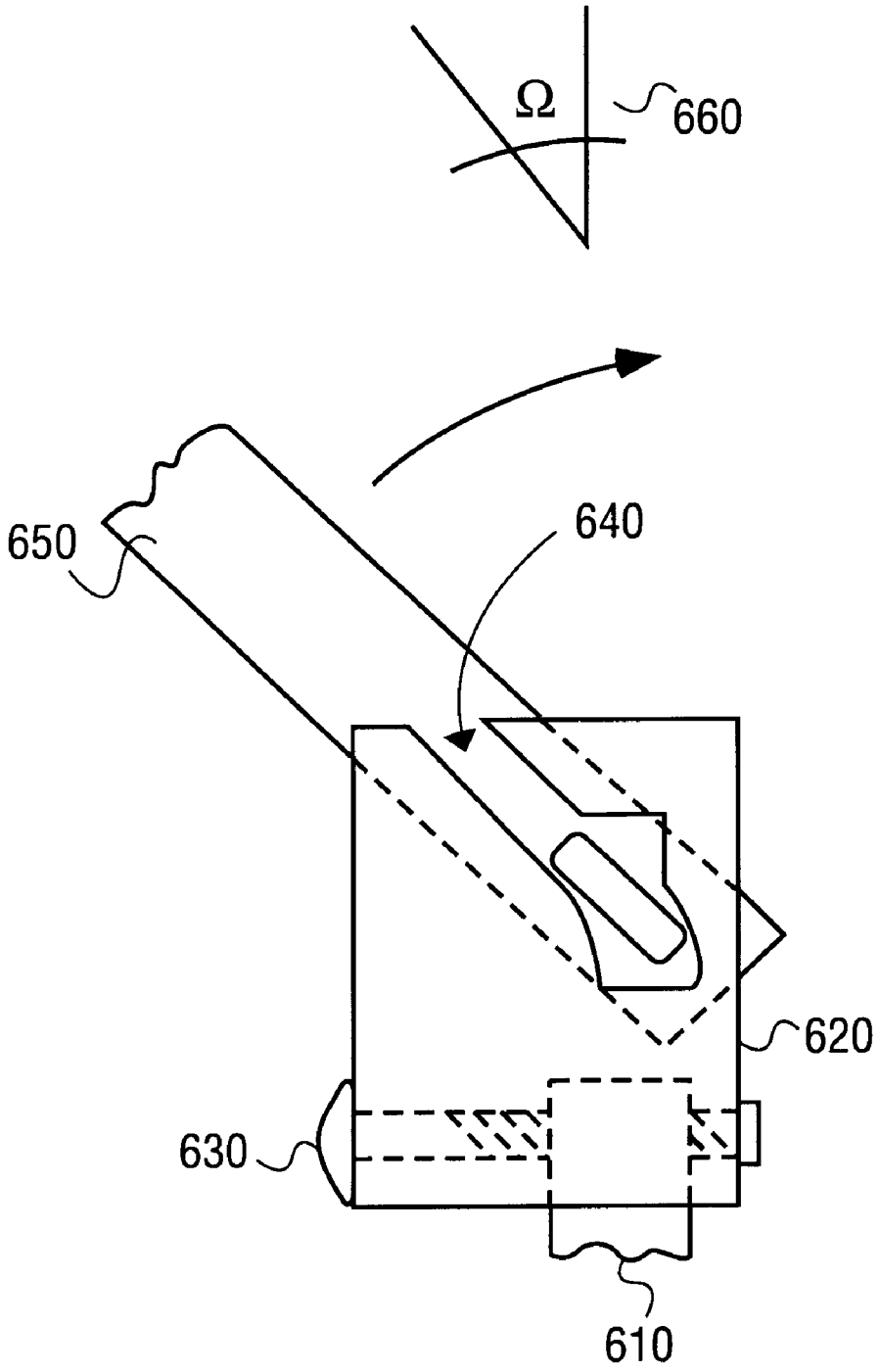
FIG. 6 is a close-up of the socket and connector at insertion.

FIG. 6 is a close-up of the socket and connector at insertion. The daughter board 650 is being inserted at an angle Ω 660 into a slot 640 in the socket 620. The socket 620 is attached to a mother board 610 using a screw 630. The angle Ω 660 of insertion depends on the amount of wipe needed. For one embodiment, the angle Ω 660 of insertion is 10 degrees from normal. The daughter board 650 is then rotated, to couple the daughter board 650 to the mother board 610.

Figure 7:
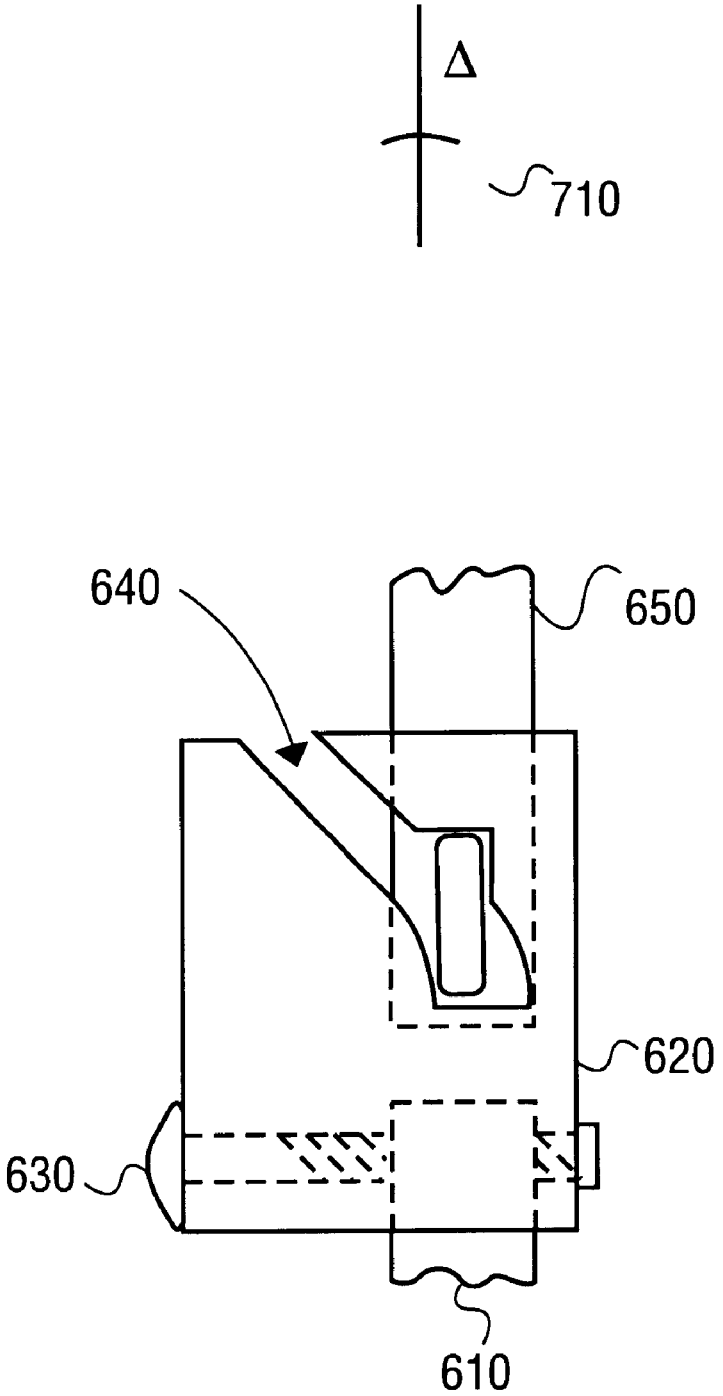
FIG. 7 is a close-up of the socket and connector at fastening.

FIG. 7 is a close-up of the socket 620 and connector 660 at fastening. Here, the daughter board 650 has been rotated to the normal angle Δ 710. For one embodiment, angle Δ 710 is a 90 degree angle. The movement from angle Ω 660 to angle Δ 710 causes the leads of the daughter board 650 to be wiped against the leads of the mother board 610. This wiping action cleans dirt and oxidation off the leads, thereby improving the electrical connection between the leads of the mother board 610 and daughter board 650. Because wipe produces wear on the contacts, the area of the wipe is minimized. This is accomplished by shifting the cam follower on the daughter board such that it is below the middle of the board. By shifting the cam follower, the movement of the leads is reduced, and the leverage is increased. The increased leverage is advantageous because it produces the requisite force for a good electrical connection between the mother board and daughter board.

Figure 8:
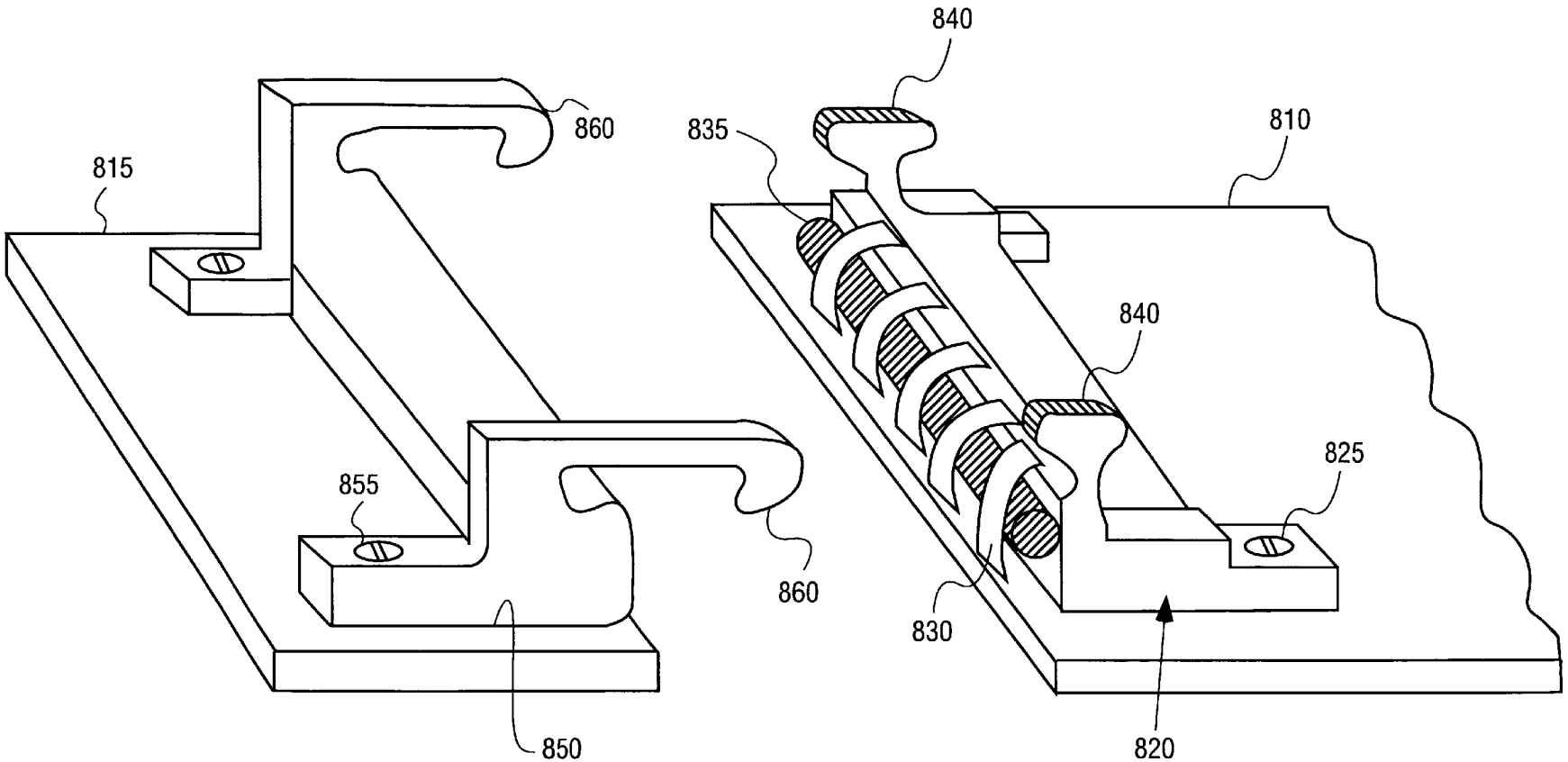
FIG. 8 is an illustration of an alternative embodiment of the connectors.

FIG. 8 is an illustration of an alternative embodiment of the socket and connector joining printed circuit boards. A daughter board 810 is designed to be coupled to a mother board 815. A connector 820 is attached to the daughter board 810. For one embodiment, a screw 825 is used to attach the connector 820 to the daughter board 810. The connector 820 has a flat connector base which is attached to the daughter board 810 and a protrusion 840 shaped like an oval. The base of the connector 820 faces the end of the daughter board 810. Signal leads 830 are wrapped around the base of the connector 820. The signal leads 830 are coupled to traces (not shown) on the daughter board 810, and extend those traces around the bottom of the connector 820. An elastomer 835 is placed between the signal leads 830 and the bottom of the connector 820 in order to provide flexibility. For one embodiment the elastomer 835 is held in place by the signal leads 830 and the bottom of the connector 820. Alternatively, the elastomer 835 may be glued to the bottom of the connector 820 using an adhesive.

The mother board 815 has a socket 850 attached to it. For one embodiment, the socket 850 is attached to the mother board 815 using a screw 855. The socket 850 has a flat socket base which is coupled to the mother board 815. The socket 850 further has an opening defined by a protrusion shaped like a hook 860. The hook 860 is to engage the oval shaped projections 840 on the connector 820 attached to the daughter board 810. Thus, when the connector 820 is engaged with the socket 850, the protrusion 840 is inserted into the hook 860 of the socket 850. Leads attached to traces on the mother board 815 are wrapped around the underside of the socket 850. When the connector 820 and the socket 850 are engaged, the leads of the mother board 815 are coupled to the signal leads 830 of the daughter board 810. When the connector 820 and socket 850 are engaged, the connection applies pressure on the daughter board, and thereby deforming the elastomer 835 underneath the signal leads 830 of the daughter board 810. The elastomer 835 takes the pressure off the signal leads 830.

Figure 9:
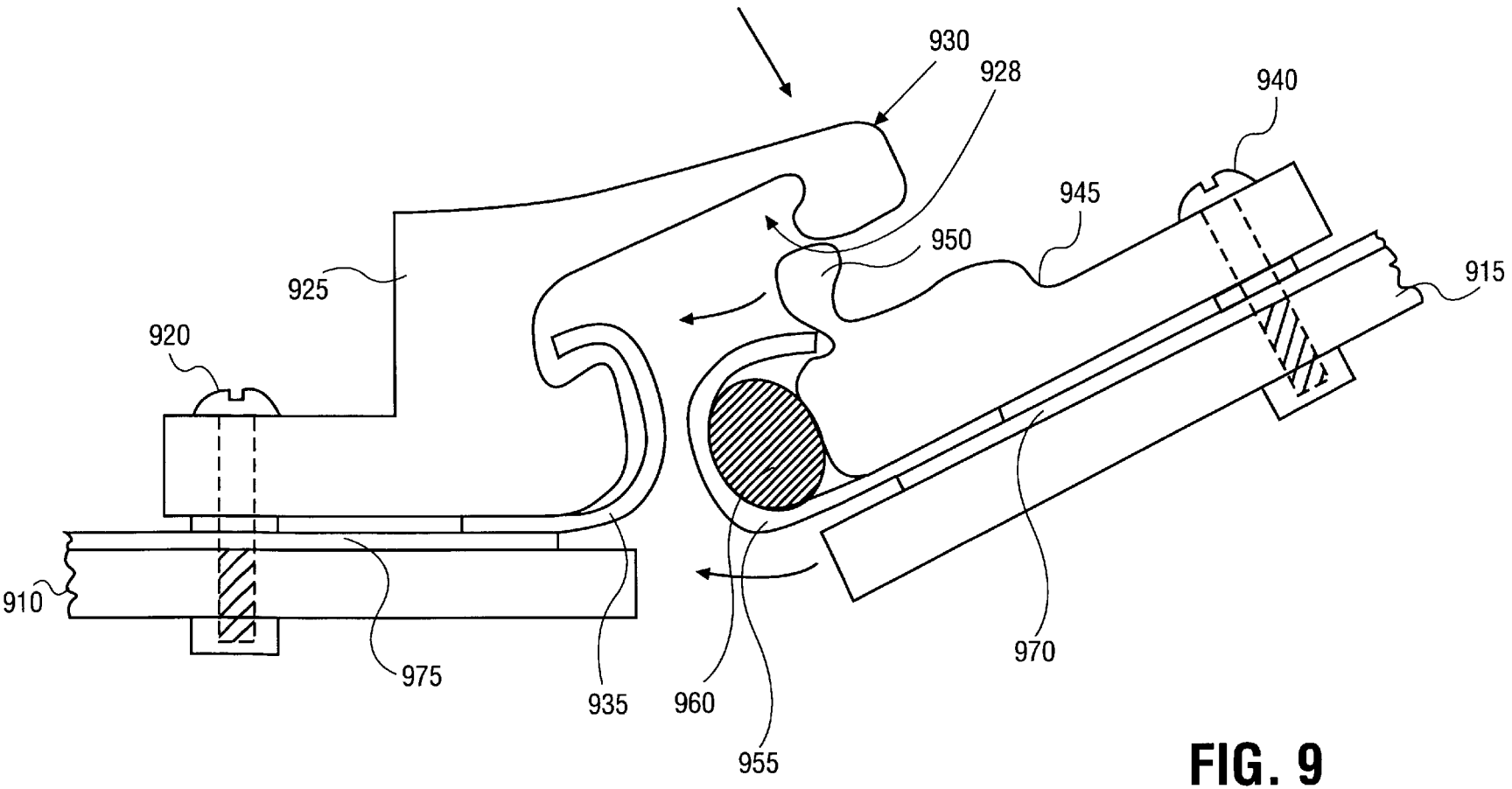
FIG. 9 is an illustration of another alternative embodiment of the connectors.

FIG. 9 is an illustration of another alternative embodiment of the printed circuit boards. The arrangement is similar to the arrangement described above. A connector 945 is attached to the daughter board 915 using a screw 940, or other means of attachment. The connector 945 has a protrusion 950 shaped like a knob at its top, while its base is attached to the daughter board 915. The traces 970 on the daughter board 915 are coupled to signal leads 955. The signal leads are wrapped around an elastomer 960, which is coupled to the connector 945.

A socket 925 is attached to the mother board 910 using a screw 920. Traces 975 on the mother board 910 are coupled to leads 935, which are wrapped around the front of the socket 925. The leads 935 of the mother board 910 are in contact with the leads 955 of the daughter board 915 when the mother board 910 and daughter board 915 are coupled to each other. The socket 925 has an opening 928 defined by a protrusion shaped like a hook 930. The hook 930 is slightly flexible, such that when the protrusion 950 of the connector 945 is inserted into the socket 925, the hook 930 flexes, permitting insertion.

In the foregoing specification, the invention has been described with reference to specific embodiments. It will, however, be evident that various modifications and changes may be made without departing from the broader spirit and scope of the invention. The specification and drawings are to be regarded in an illustrative rather than a restrictive sense.

What is claimed is:

1. An electrical apparatus comprising:

(1) a first connector coupled to a first circuit board, wherein the first connector comprises:
  (a) an elastomer;
  (b) a first flex circuit coupled to the first circuit board and having a first connection portion coupled to the elastomer for spring force;
  (c) a cam follower positioned at one end of the first connector;

(2) a second connector coupled to a second circuit board, wherein the second connector comprises:
  (a) a second flex circuit coupled to the second circuit board and having a second connection portion;
  (b) a socket with an opening that comprises:
    (i) an insertion portion with a side angled from a plane of the second circuit board:
    (ii) a central portion with a side substantially parallel to the plane of the second circuit board, wherein the opening allows the cam follower to be inserted laterally and then rotated when the first connector is rotated with respect to the second connector in order to provide a wiping action between the first and second connection portions of the first and second flex circuits when the first connector is coupled to the second connector.

2. The electrical apparatus of claim 1, wherein the second connector further comprises a latch for keeping the first circuit board in place.

3. The electrical apparatus of claim 1, wherein the first flex circuit of the first connector is electrically coupled to a dynamic random access memory (DRAM) coupled to the first circuit board.

4. The electrical apparatus of claim 3, wherein the second flex circuit of the second connector is electrically coupled to a DRAM controller coupled to the second circuit board.

5. The electrical apparatus of claim 1, wherein the first connection portion of the first flex circuit of the first connector comprises:

a flexible layer in contact with the elastomer;

a conductive layer comprising a plurality of signal traces;

a plurality of layers residing over the signal traces.

6. The electrical apparatus of claim 5, wherein the flexible layer comprises polymide, wherein the signal traces are comprised of copper, and wherein the plurality of layers residing over the signal traces comprise a first layer of nickel and a second layer of gold.

7. The electrical apparatus of claim 1, wherein the second connection portion of the second flex circuit of the second connector comprises:

a first layer in contact with the second board;

a conductive layer comprising leads;

a plurality of layers residing over the leads.

8. The electrical apparatus of claim 7, wherein the first logic layer comprises polymide, wherein the leads of the conductive layer are comprised of copper, and wherein the plurality of layers residing over the leads comprise a nickel layer and a gold layer.

9. The electrical apparatus of claim 1, wherein the elastomer is selected from the group consisting of fluorosilicone, silicone rubber, and fluoroelastomer.

10. An electrical apparatus comprising:

(1) a first connector coupled to a first circuit board, wherein the first connector comprises:
  (a) an elastomer residing at an end of the first circuit board;
  (b) first signal leads wrapped around the elastomer;
  (c) a cam follower coupled to a side of the first circuit board positioned at one end of the fir connector;

(2) a second connector coupled to a second circuit board, wherein the second connector comprises:
  (a) second signal leads wrapped around an end of the second circuit board;
  (b) a socket with an opening that comprises:
    (i) an insertion portion with a side angled from a plane of the second board:
    (ii) a central portion with a side substantially parallel to the plane of the second board, wherein the opening allows the cam follower to be inserted laterally and then rotated when the first connector is rotated with respect to the second connector in order to provide a wiping action between the first and second signal leads when the first connector is coupled to the second connector.

11. The electrical apparatus of claim 10, wherein the cam follower and the socket are comprised of plastic.

12. The electrical apparatus of claim 10, wherein the cam follower and the socket are comprised of metal.

13. An electrical apparatus comprising:

(1) a first connector coupled to a first circuit board, wherein the first connector comprises:
  (a) a base;
  (b) an elastomer residing at an end of the base of the first connector;
  (c) first signal leads wrapped around the elastomer;
  (d) a protrusion coupled to the first circuit board and having a curved end;

(2) a second connector coupled to a second circuit board, wherein the second connector comprises:
  (a) a base;
  (b) second signal leads wrapped around an end of the base of the second connector;
  (c) a hook coupled to the second circuit board to engage the curved end of the protrusion of the first connector in order to connect the first signal leads of the first connector to the second signal leads of the second connector when the first connector couples to the second connector.

14. The electrical apparatus of claim 13, wherein the curved end of the protrusion of the first connector is substantially oval-shaped.

15. The electrical apparatus of claim 13, wherein the curved end of the protrusion of the first connector is substantially shaped like a knob.

16. The electrical apparatus of claim 13, wherein the elastomer to glued to the end of the base of the first connector.

* * * * *